US006922928B2

(12) United States Patent
Shih

(10) Patent No.: US 6,922,928 B2
(45) Date of Patent: Aug. 2, 2005

(54) MULTI-PICTURE FRAME

(76) Inventor: Sam W. Shih, 19722 Calle Estito, Walnut, CA (US) 91789

( * ) Notice: Subject to any disclaimer, the term of this patent is extended or adjusted under 35 U.S.C. 154(b) by 603 days.

(21) Appl. No.: 09/829,459

(22) Filed: Apr. 9, 2001

(65) Prior Publication Data

US 2002/0144444 A1 Oct. 10, 2002

(51) Int. Cl.[7] ..... G09F 11/12; G09F 19/00
(52) U.S. Cl. ..... 40/438; 40/472
(58) Field of Search ..... 40/438, 471, 472

(56) References Cited

U.S. PATENT DOCUMENTS 151,544 A * 6/1874 Moore ..... 40/438
1,403,631 A * 1/1922 Pyper ..... 40/438
2,092,247 A * 9/1937 Glagau ..... 40/438
2,102,474 A * 12/1937 McKenna et al. ..... 40/438
3,634,959 A * 1/1972 Goodrich ..... 40/438

* cited by examiner

*Primary Examiner*—Cassandra Davis
(74) *Attorney, Agent, or Firm*—Raymond Y. Chan; David and Raymond

(57) ABSTRACT

A multi-picture frame includes a picture panel having a front transparent surface, a casing having a receiving chamber mounted at a back of the picture panel, a picture film rotatably supported in the casing and adapted for being view from the front transparent surface of the picture panel, a light source disposed in the receiving chamber of the casing, a moving picture frame mounted between the picture panel and the light source, comprising a rolling device mounted in the casing and a shader slide arranged to be rotatably driven by the rolling device, and an electric input electrically connected the light source and the moving picture frame to a power source respectively. Therefore, the light source generates light which is adapted for passing through the shader slide to the picture film so as to reflect a moving image of the shader slide on the picture film.

20 Claims, 7 Drawing Sheets

MULTI-PICTURE FRAME

BACKGROUND OF THE PRESENT INVENTION

1. Field of Invention

The present invention relates to a picture frame, and more particularly to a multi-picture frame which can support a fixed picture and at least a moving picture incorporating with the fixed picture for providing an aesthetic and picturesque artwork.

2. Description of Related Arts

People like to place a piece of artwork work such as a picture in the house to provide an aesthetic appearance of the house. Conventionally, the picture is supported by a picture frame which is adapted for suspendedly mounting on a wall. However, the picture will only provide a monotonous atmosphere. So, after a period of time, people may feel tedious and merely change a new picture to substitute the old one.

Moreover, such static picture cannot provide a motional appearance especially describing a moving object such as falling water. So, most of the pictures fail to give people a great impression. Thus, when people see a dynamic picture which likes a living object, they may feel energetic.

SUMMARY OF THE PRESENT INVENTION

A main object of the present invention is to provide a multi-picture frame which can provide a picturesque artwork in dynamic manner.

Another object of the present invention is to provide a multi-picture frame which is adapted for supporting a fixed picture and a moving picture incorporating with the fixed picture so as to provide a depth of the fixed picture in a 3D manner.

Another object of the present invention is to provide a multi-picture frame which comprises an illuminating unit for providing an aesthetic lighting effect to the multi-picture frame.

Accordingly, in order to accomplish the above objects, the present invention provides a multi-picture frame, comprising:

a picture panel having a front transparent surface;

a casing having a receiving chamber mounted at a back of the picture panel;

at least a picture film rotatably supported in the casing and adapted for being view from the front transparent surface of the picture panel wherein the picture film has a plurality of transparent areas provided thereon adapted for enabling a light passing therethrough;

a light source disposed in the receiving chamber of the casing;

a moving picture frame mounted between the picture panel and the light source, comprising a rolling device rotatably supported in the casing and a shader slide arranged to be rotatably driven by the rolling device in a vertical movable manner wherein a plurality of shading bands having transparent abilities are spacedly formed on the shader slide for providing a moving image when a light is passing through the shader slide; and an electric input electrically connected the light source and the moving picture frame to a power source respectively;

thereby, the light generated by the light source is adapted for passing to the picture film through the shading bands of the shader slide so as to reflect the moving image of the shader slide on the picture film.

Alternatively, the present invention provides a multi-picture frame, comprising:

a picture panel having a front transparent surface;

a casing having a receiving chamber mounted at a back of the picture panel;

at least a picture film rotatably supported in the casing and adapted for being view from the front transparent surface of the picture panel wherein the picture film has a plurality of transparent areas provided thereon adapted for enabling a light passing therethrough;

a light source disposed in the receiving chamber of the casing;

a moving picture frame mounted between the picture panel and the light source, comprising a rolling device rotatably supported in the casing and a shader slide arranged to be rotatably driven by the rolling device in a transversely movable manner wherein a plurality of shading bands having transparent abilities are spacedly formed on the shader slide for providing a moving image when a light is passing through the shader slide; and an electric input electrically connected the light source and the moving picture frame to a power source respectively;

thereby, the light generated by the light source is adapted for passing to the picture film through the shading bands of the shader slide so as to reflect the moving image of the shader slide on the picture film.

DETAILED DESCRIPTION OF THE PREFERRED EMBODIMENT

Figure 1:
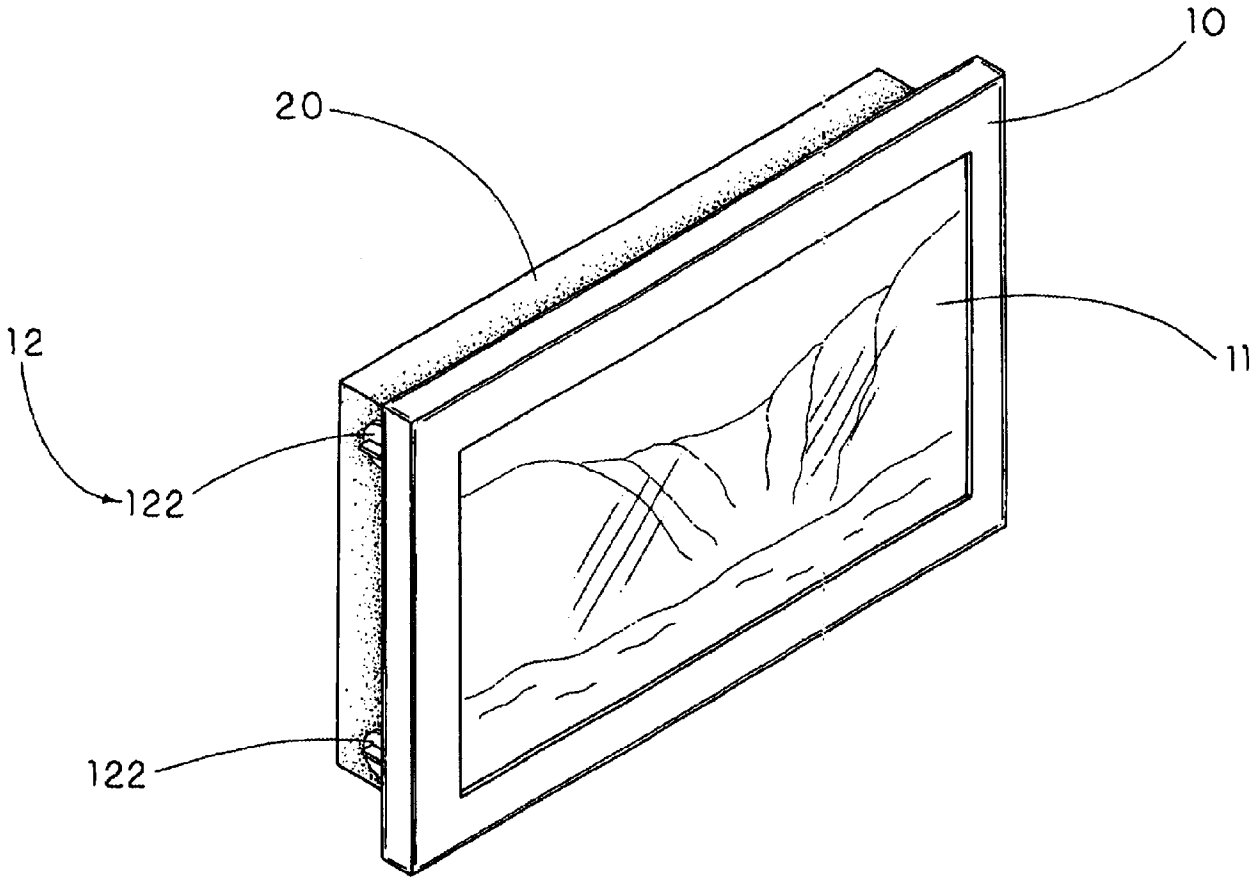
FIG. 1 is a perspective view of a multi-picture frame according to a first preferred embodiment of the present invention.
Figure 2:
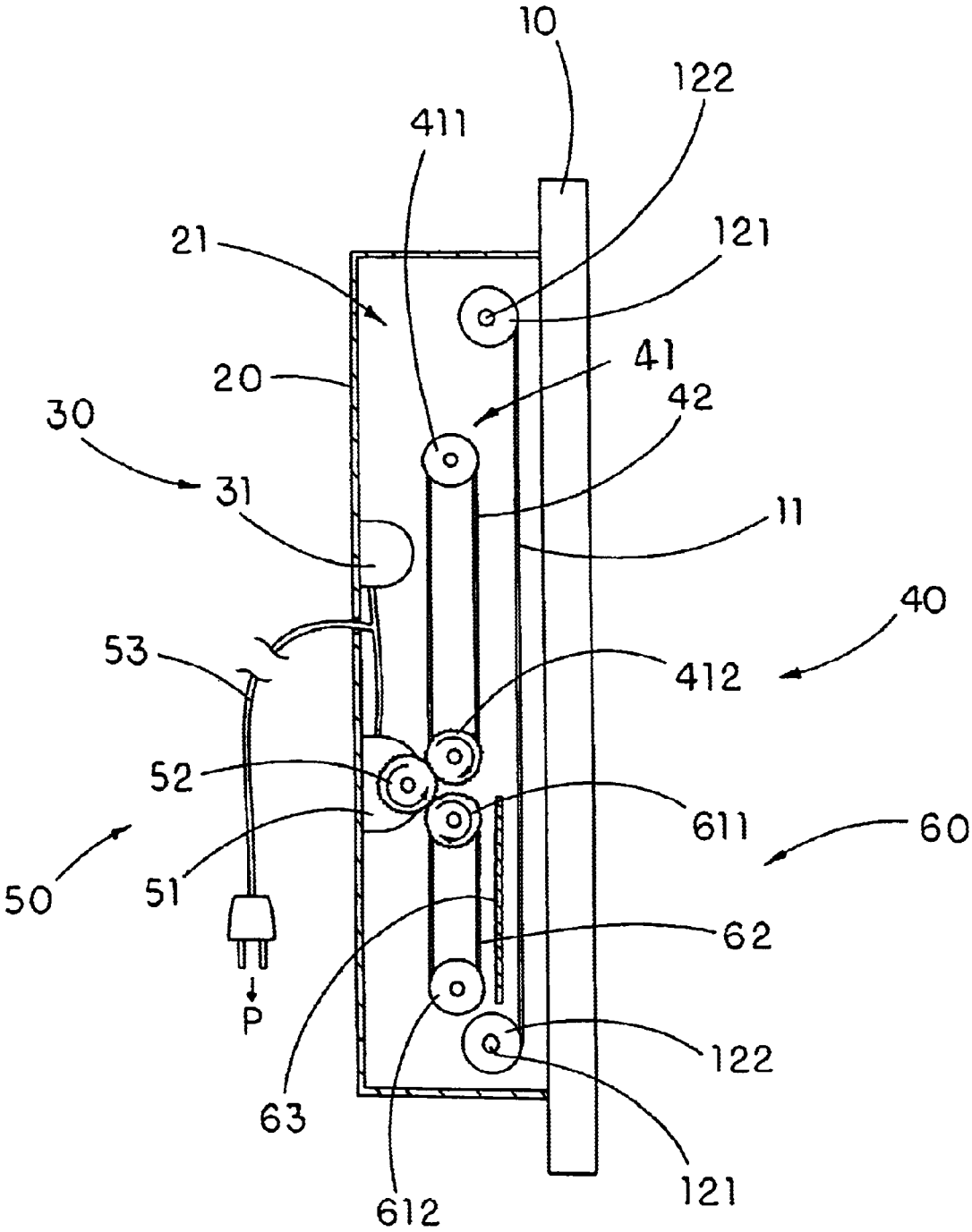
FIG. 2 is a sectional perspective view of the multi-picture frame according to the above first preferred embodiment of the present invention
Figure 3:
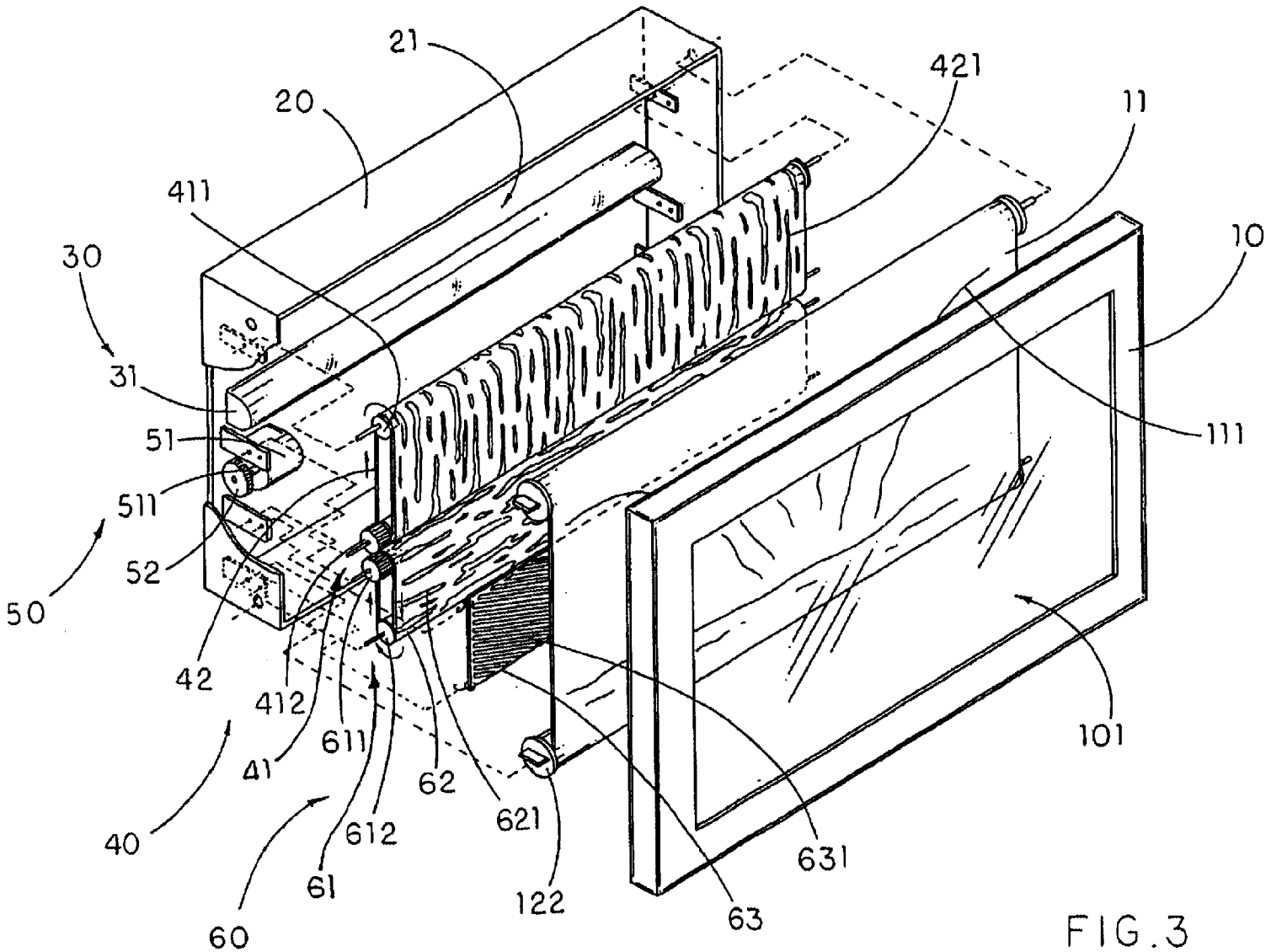
FIG. 3 is an exploded perspective view of the multi-picture frame according to the above first preferred embodiment of the present invention.

Referring to FIGS. 1 through 3 of the drawings, a multi-picture frame according to a preferred embodiment of the present invention. The multi-picture frame comprises a picture panel 10 having a front transparent surface 101, a casing 20 having a receiving chamber 21 mounted on a back of the picture panel 10, at least a picture film 11 rotatably supported in the casing 20 and adapted for being view from the front transparent surface 101 of the picture panel 10 wherein the picture film 11 has a plurality of transparent areas 111 provided thereon adapted for enabling a light passing therethrough, and a light source 30 disposed in the receiving chamber 21.

The multi-picture frame further comprises a moving picture frame 40, which mounted between the picture panel 10 and the light source 30, comprising a rolling device 41 rotatably mounted in the casing 20 and a shader slide 42 arranged to be rotatably driven by the rolling device 41, and an electric input 50 electrically connected the light source 30 and the moving picture frame 40 to a power source P respectively.

The casing 20 is made of durable and rigid material such as wood that can substantially supports the picture panel 10 wherein the casing 20 further comprises a hanging means 22 provided thereon for hanging the multi-picture frame on a wall or a supporting surface.

The light source 30 according to the preferred embodiment is a fluorescent light 31 transversely mounted in the receiving chamber 21 wherein the fluorescent light 31 of the light source 30 is adapted for generating light which is adapted for passing through the shader slide 42 to the picture film 11 of the picture panel 10 so as to reflect a moving image of the shader slide 42 on the picture film 11.

The fluorescent light 31 of the light source 30 is adapted for providing different color of light in such a manner that when the light from the fluorescent light 31 can be reflected on the picture film 11 through the shader slide 42 of the moving picture frame 40 so as to enhance the aesthetic appearance of the picture film 11. Alternatively, light bulbs can be used instead of the fluorescent light 31 of the light source 30 for producing lights to the picture film 11.

According to the preferred embodiment, the shader slide 42 is arranged to be rotatably driven by the rolling device 41 of the moving picture frame 40 in a vertical movable manner wherein a plurality of shading bands 421 having transparent abilities are vertically and spacedly formed on the shader slide 42 for providing a vertical moving image when the light is passing through the shader slide 42.

As shown in FIG. 2, the rolling device 41 of the moving picture frame 40 comprises a first roller gear 411 and a second roller gear 412 in parallel manner rotatably and horizontally mounted on an upper portion and a lower portion of the casing 20 respectively wherein the shader slide 42 is rotatably connected between the first and second roller gears 411, 412 in an endless rotating manner, as shown in FIG. 2. Accordingly, the first and second roller gears 411, 412 are mounted on an upper portion and a lower portion of the casing 20 respectively in such a manner that the shader slide 42 is adapted for rotatably sliding between the first and second roller gears 411, 412 in a vertical movable manner. So, the shader slide 42 having a predetermined image is adapted for adequately reflecting on the picture film 11 of the picture panel 10 in a vertical moving manner.

The electric input 50 comprises a motor 51 supported in the receiving chamber 21 for driving an output axle 511 rotate, a driving gear 52 connected to the output axle which drives the second roller gear 412 to rotate, and an electric cable 53 for electrically connected to the light source 30 and a motor 51 respectively electrically extended to the power source P which is a power outlet of a house.

The multi-picture frame further comprises an auxiliary moving picture frame 60 supported between the picture panel 10 and the light source 30 comprising an auxiliary rolling device 61 rotatably supported in the casing 20 and an auxiliary shader slide 62 arranged to be rotatably driven by the auxiliary rolling device 61 in a vertical movable manner wherein a plurality of shading stripes 622 having a transparent abilities are longitudinally and spacedly formed on the auxiliary shader slide 62 for providing a moving image when the light is passing through the auxiliary shader slide 62.

The auxiliary moving picture frame 60 further comprises a shader film 63 supported in front of the auxiliary shader slide 62 wherein a plurality of shading steaks 631 having transparent abilities are inclinedly and spacedly formed on the shader film 63 for providing a transversely moving image on the picture film 11 when the light is passing through the auxiliary shader slide 62 and the shader film 63 respectively.

The auxiliary rolling device 61 of the auxiliary moving picture frame 60 comprises a first auxiliary roller gear 611 and a second auxiliary roller gear 612 in parallel manner rotatably and horizontally mounted on two opposed portions of the casing 20 respectively wherein the auxiliary shader slide 62 is rotatably connected between the first and second auxiliary roller gears 611, 612 in an endless rotating manner.

Accordingly, the first and second roller gears 411, 412 are positioned parallel to the auxiliary first and second roller gears 611, 612, wherein the first auxiliary roller gear 611 is rotatably engaged with the second roller gear 412 in such a manner that the driving gear 52 drives the second roller gear 412 of the moving picture frame 40 and the first auxiliary roller gear 611 to rotate at the same time.

It is worth to mention that the moving picture frame 40 is adapted for providing a reflecting image movement on the picture film 11 wherein the moving picture frame 40 is capably of creating a vertical movement by the vertical shading bands 421 of the shader slide 42 of the moving picture frame 40 and a horizontal movement by the longitudinal shading stripes 622 of the auxiliary shader slide 62 of the auxiliary moving picture frame 60, so as to providing varies reflecting images according to dynamic expressions of the picture film 11. In other words, when the picture film 11 illustrates a waterfall, the moving picture frame 40 can provide a vertical reflecting image movement on the picture film 11 from a top to a bottom thereof. Likewise, when the picture film 11 illustrates a moving object from left to right, the auxiliary moving picture frame 60 can provide a horizontal reflecting image movement on the picture film 11 from left to right.

As shown in FIG. 3, the picture panel 10 further comprises a film tension adjusting unit 12 for maintaining a tension of the picture film 11. The film tension adjusting unit 12 comprises a pair of adjusting shafts 121 rotatably affixed between two opposed sidewalls of the casing 20 respectively wherein a free end of each adjusting shaft 121 is penetrated through one of the sidewalls casing 20 to outside, and a pair of operating buttons 122 affixed to two free ends of the adjusting shafts 121 respectively and arranged to rotatably move the picture film 11 through the adjusting shafts 121.

Accordingly, the two adjusting shafts 121 are horizontally affixed between a top portion and a bottom edge portion of the casing 20 respectively wherein the two free ends of the adjustably shafts 121 are penetrated the sidewall of the casing 20 respectively in such a manner that the two operating buttons 122 are adapted for rotatably sliding the picture film 11 in a vertical movable manner so as to adjustively maintain the tension of the picture film 11.

It is worth to mention that when the two adjusting shafts 121 are adapted for vertically affixing to two side edge portions of the casing 20 respectively and the two operating buttons 122 are rotatably mounted on a top wall of the casing 20 so as to rotatably moving the picture film 11 in a horizontal movable manner for horizontally maintaining the tension of the picture film 11.

Figure 4:
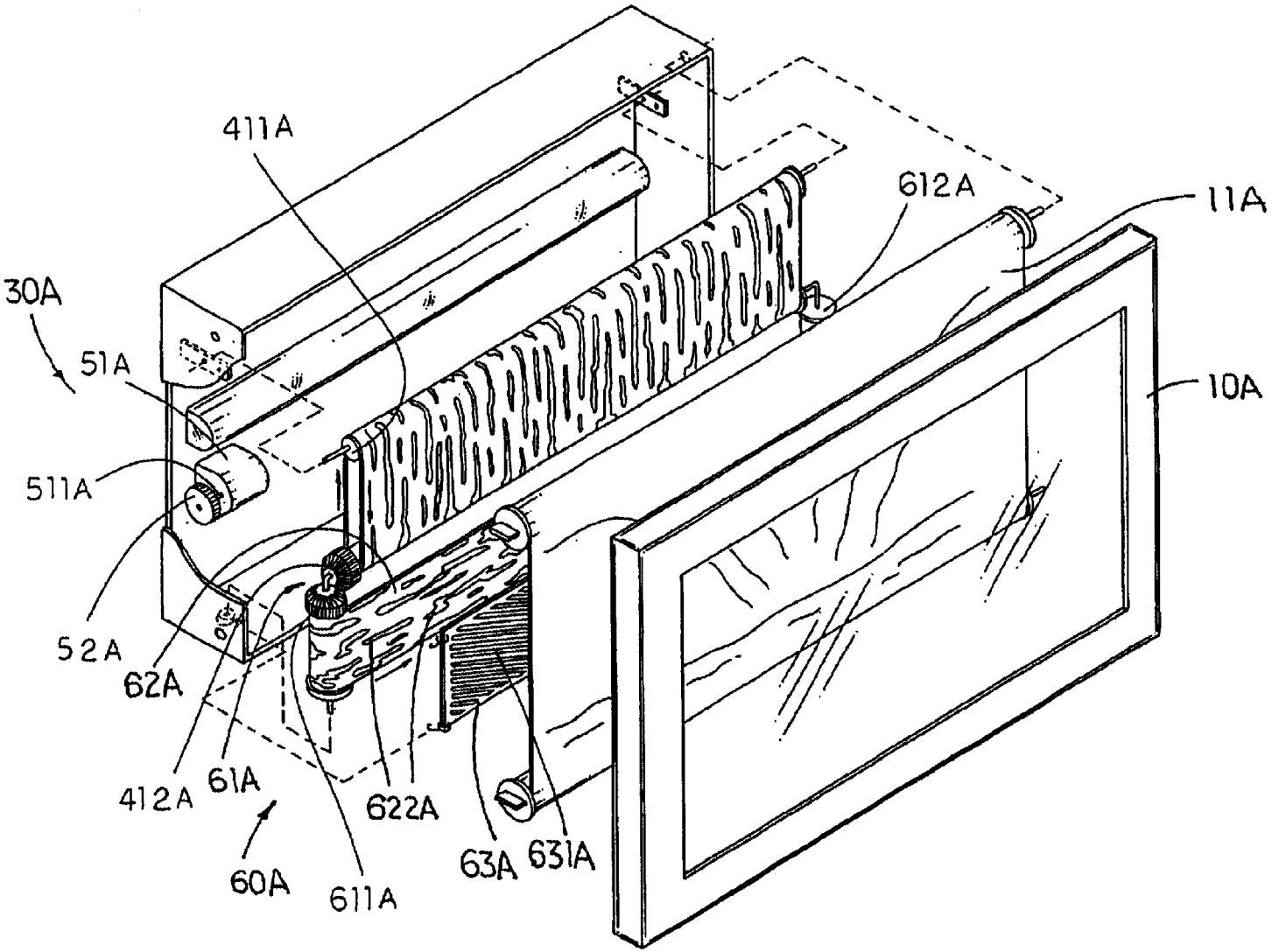
FIG. 4 illustrates an alternative mode of an auxiliary moving picture frame of the multi-picture frame according to the above first preferred embodiment of the present invention.

FIG. 4 illustrates an alternative mode of the auxiliary moving picture frame 60A which is supported between the picture panel 10A and the light source 30A wherein the auxiliary moving picture 60A comprises an auxiliary rolling device 61A rotatably supported in the casing 20A and an auxiliary shader slide 62A arranged to be rotatably driven by the auxiliary rolling device 61A in a longitudinal movable manner wherein a plurality of shading stripes 622A having a transparent abilities are inclinedly and spacedly formed on the auxiliary shader slide 62A for providing a transversely moving image when the light is passing through the auxiliary shader slide 62A.

The shader film 63A is supported in front of the auxiliary shader slide 62A wherein a plurality of shading steaks 631A having transparent abilities are longitudinally and spacedly formed on the shader film 63A for providing a transversely moving image on the picture film 11A when the light is passing through the auxiliary shader slide 62A and the shader film 63A respectively.

The auxiliary rolling device 61A of the auxiliary moving picture frame 60A comprises a first auxiliary roller gear 611A and a second auxiliary roller gear 612A in parallel manner rotatably mounted on two side portions of the casing 20A respectively wherein the auxiliary shader slide 62A is rotatably connected between the first and second auxiliary roller gears 611A, 612A in an endless rotating manner.

Accordingly, the first and second roller gears 411A, 412A are positioned perpendicularly to the auxiliary first and second roller gears 611A, 612A, wherein the first auxiliary roller gear 611A is rotatably engaged with the second roller gear 412A in such a manner that the driving gear 52A drives the second roller gear 412A of the moving picture frame 40A and the first auxiliary roller gear 611A to rotate at the same time.

Figure 5:
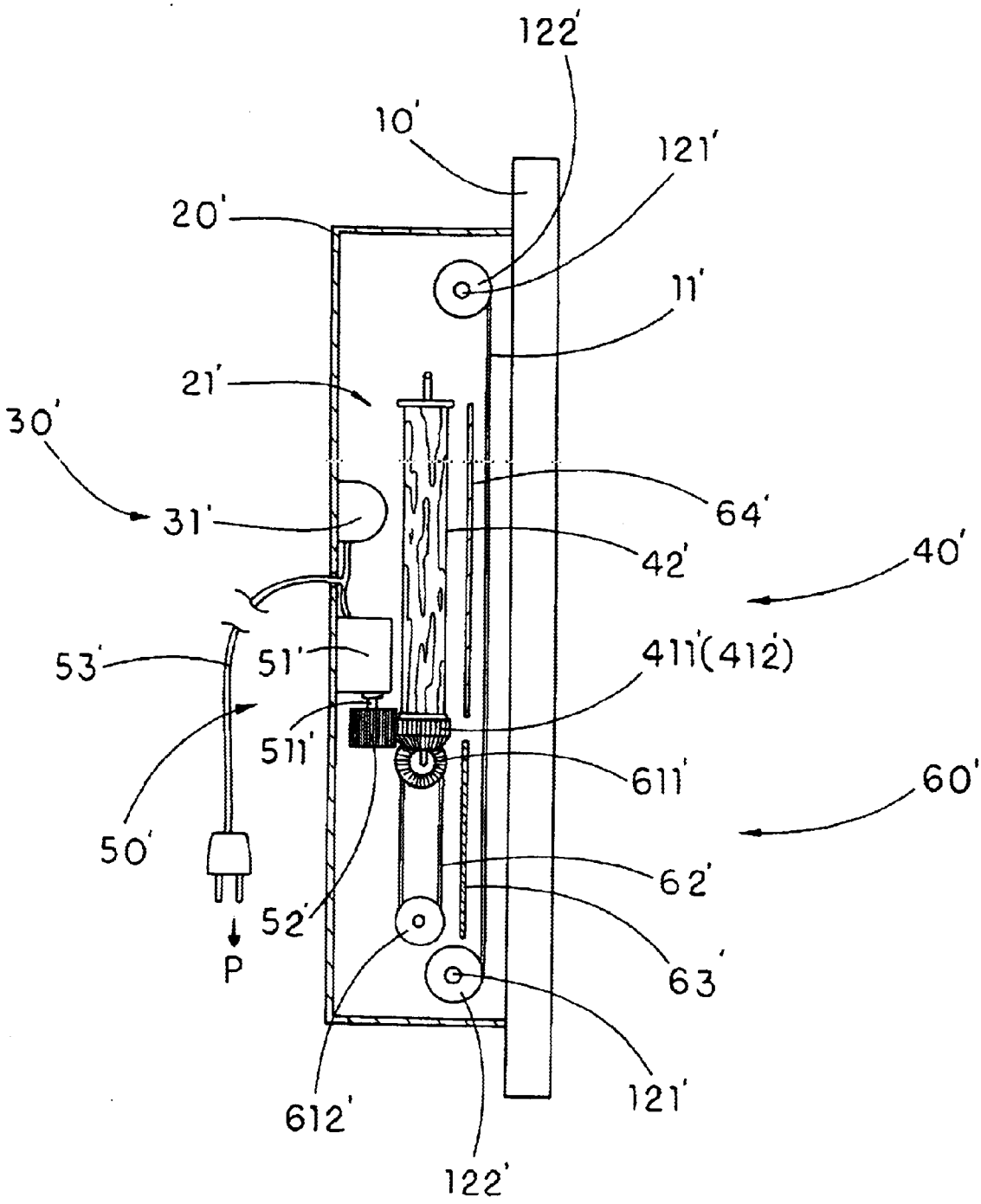
FIG. 5 is a sectional view of the multi-picture frame according to a second preferred embodiment of the present invention.
Figure 6:
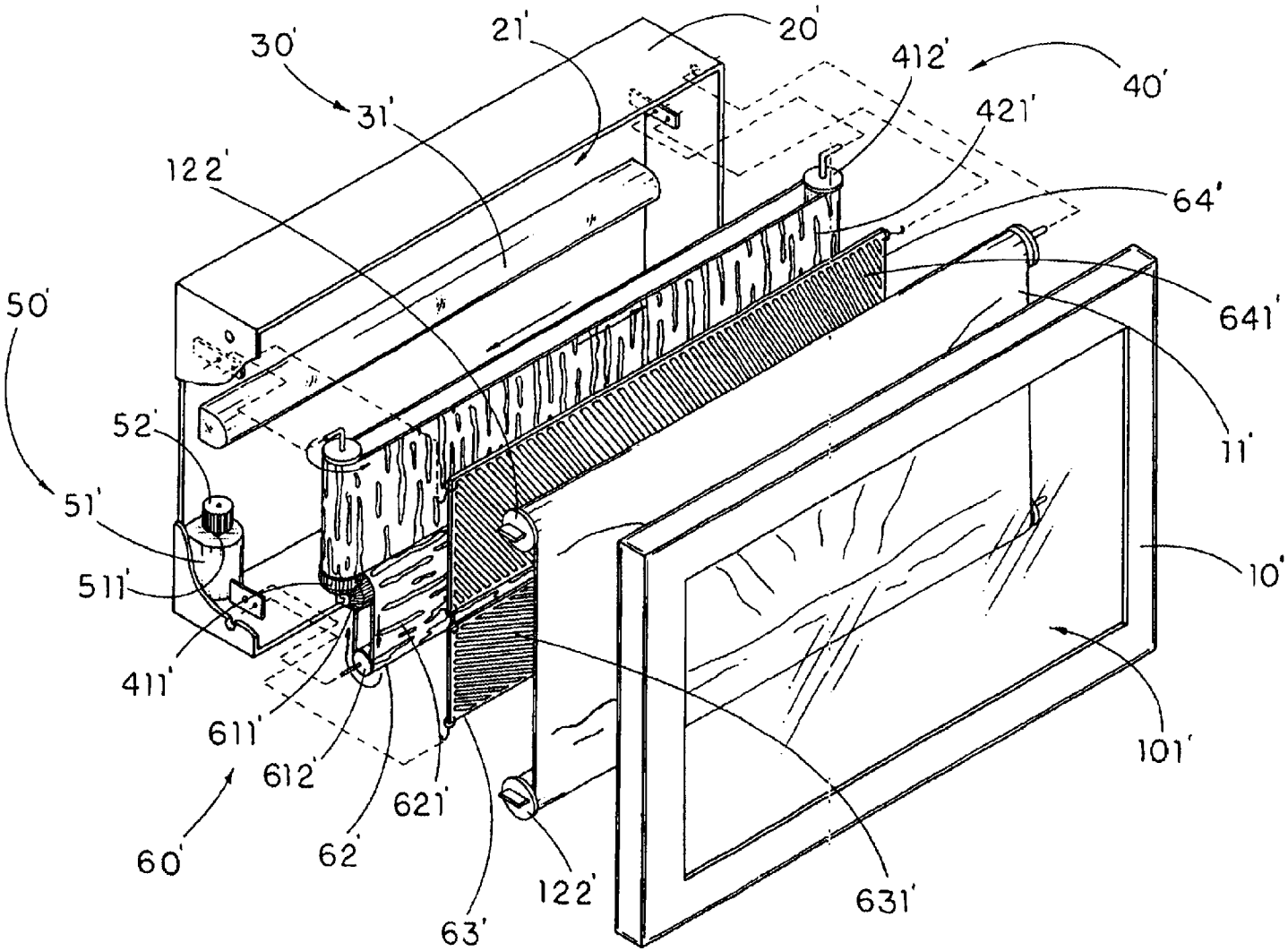
FIG. 6 is an exploded perspective view of the multi-picture frame according to the above second preferred embodiment of the present invention.

Referring to FIGS. 5 and 6, a second embodiment of the present invention illustrates an alternative mode of the moving picture frame 40' of the above preferred embodiment, wherein the first and second roller gears 411', 412' of the moving picture frame 40' is rotatably and vertical mounted on two side portions of the casing 20' respectively.

The shader slide 42' is rotatably connected between the first and second roller gears 411', 412' in an endless rotating manner, as shown in FIG. 5, in such a manner that the shader slide 42' is adapted for rotatably sliding between the first and second roller gears 411', 412' in a transversely movable manner. A plurality of shading bands 421' having transparent abilities are inclinedly and spacedly formed on the shader slide 42' for providing a moving image when the light is passing through the shader slide 42'.

The auxiliary moving picture frame 60', which is supported between the picture panel 10' and the light source 30', comprises an auxiliary rolling device 61' rotatably supported in the casing 20' and an auxiliary shader slide 62' arranged to be rotatably driven by the auxiliary rolling device 61' in a vertical movable manner wherein a plurality of shading stripes 622' having a transparent abilities are longitudinally and spacedly formed on the auxiliary shader slide 62' for providing a moving image when the light is passing through the auxiliary shader slide 62'.

The auxiliary moving picture frame 60' further comprises a first shader film 63' supported in front of the auxiliary shader slide 62' and second shader film 64' supported in front of the shader slide 42'. The first shade film 63' comprises a plurality of first shading steaks 631' having transparent abilities are inclinedly and spacedly formed on the shader film 63' for providing a transversely moving image on the picture film 11' when the light is passing through the auxiliary shader slide 62' and the first shader film 63' respectively. The second shader film 64' comprises a plurality of second shading steaks 641' having transparent abilities are inclinedly and spacedly formed on the second shader film 64' for providing a transversely moving image on the picture film 11' when the light is passing through the shader slide 42' and the second shader film 64' respectively. The first shading steaks 631' and the second shading steaks 641' are inclinedly extended in opposite directions.

The auxiliary rolling device 61' of the auxiliary moving picture frame 60' comprises a first auxiliary roller gear 611' and a second auxiliary roller gear 612' in parallel manner rotatably and horizontally mounted on two opposed portions of the casing 20' respectively wherein the auxiliary shader slide 62' is rotatably connected between the first and second auxiliary roller gears 611', 612' in an endless rotating manner.

Accordingly, the first and second roller gears 411', 412' are positioned perpendicularly to the auxiliary first and second roller gears 611', 612', wherein the first auxiliary roller gear 611' is rotatably engaged with the second roller gear 412' in such a manner that the driving gear 52' drives the second roller gear 412' of the moving picture frame 40' and the first auxiliary roller gear 611' to rotate at the same time.

Figure 7:
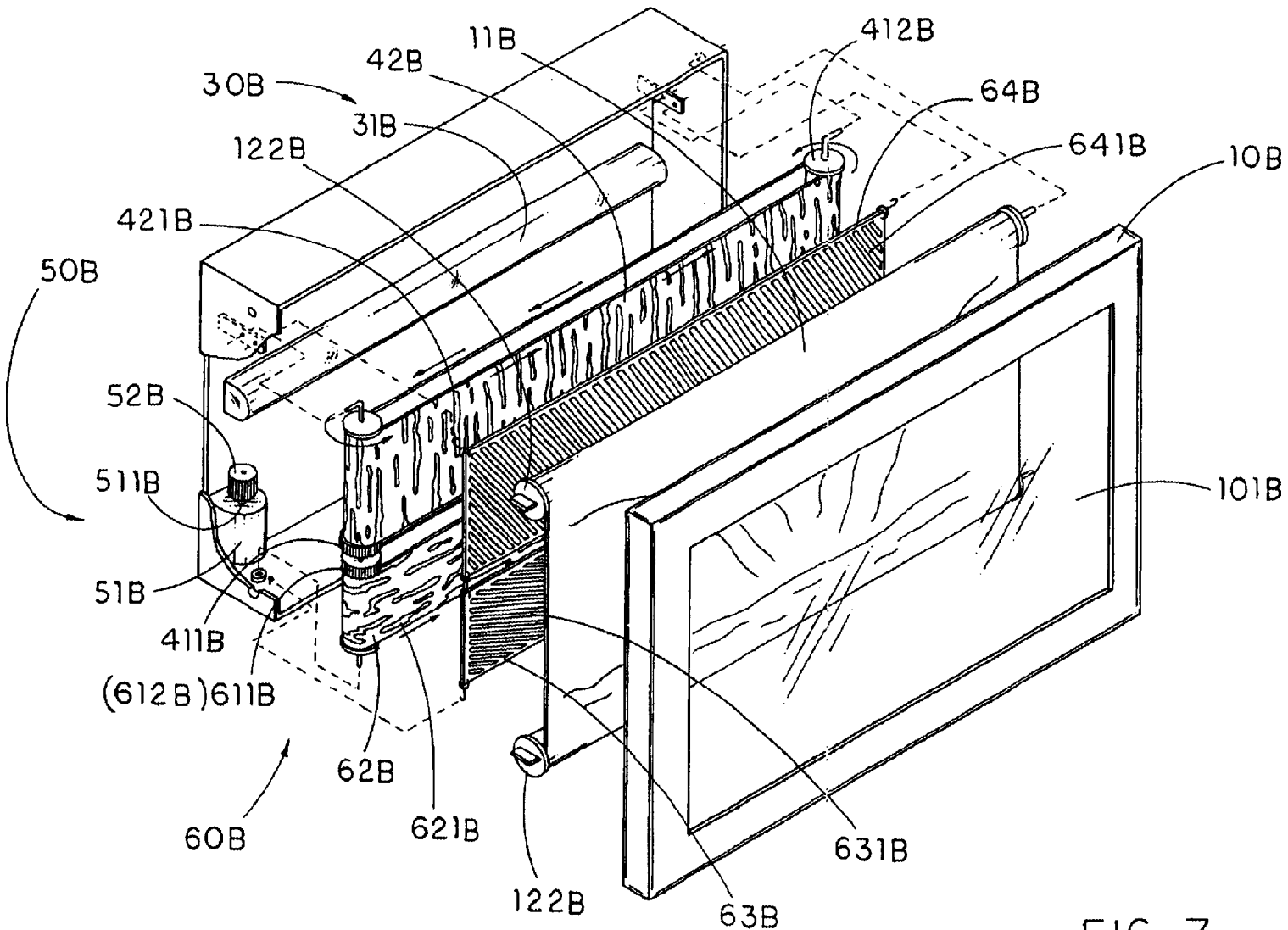
FIG. 7 illustrates an alternative mode of an auxiliary moving picture frame of the multi-picture frame according to the above second preferred embodiment of the present invention

FIG. 7 illustrates an alternative mode of the auxiliary moving picture frame 60B which is supported between the picture panel 10B and the light source 30B wherein the auxiliary moving picture 60B comprises an auxiliary rolling device 61B rotatably supported in the casing 20B and an auxiliary shader slide 62B arranged to be rotatably driven by the auxiliary rolling device 61B in a longitudinal movable manner wherein a plurality of longitudinal shading stripes 622B having a transparent abilities are inclinedly and spacedly formed on the auxiliary shader slide 62B for providing a moving image when the light is passing through the auxiliary shader slide 62B.

The auxiliary moving picture frame 60B further comprises a first shader film 63B supported in front of the auxiliary shader slide 62B and second shader film 64B supported in front of the shader slide 42B. The first shade film 63B comprises a plurality of first shading steaks 631B having transparent abilities are longitudinally and spacedly formed on the shader film 63B for providing a transversely moving image on the picture film 11B when the light is passing through the auxiliary shader slide 62B and the first shader film 63B respectively. The second shader film 64B comprises a plurality of second shading steaks 641B having transparent abilities are inclinedly and spacedly formed on the shader film 64B for providing a transversely moving image on the picture film 11B when the light is passing through the shader slide 42B and the second shader film 64B respectively.

The auxiliary rolling device 61B of the auxiliary moving picture frame 60B comprises a first auxiliary roller gear 611B and a second auxiliary roller gear 612B in parallel manner rotatably mounted on two side portions of the casing 20B respectively wherein the auxiliary shader slide 62B is rotatably connected between the first and second auxiliary roller gears 611B, 612B in an endless rotating manner.

Accordingly, the first and second roller gears 411B, 412B are positioned parallel to the auxiliary first and second roller gears 611B, 612B, wherein the first auxiliary roller gear 611B is rotatably engaged with the second roller gear 412B in such a manner that the driving gear 52B drives the second roller gear 412B of the moving picture frame 40B and the first auxiliary roller gear 611B to rotate at the same time.

What is claimed is:

1. A multi-picture frame, comprising:

a picture panel having a front transparent surface;

a casing having a receiving chamber mounted at a back of said picture panel;

at least a picture film rotatably supported in said casing and adapted for being view from said front transparent surface of said picture panel wherein said picture film has a plurality of transparent areas provided thereon adapted for enabling a light passing therethrough a light source disposed in said receiving chamber of said casing; and a moving picture frame mounted between said picture panel and said light source, comprising a rolling device rotatably supported in said casing and a shader slide arranged to be rotatably driven by said rolling device in a vertical movable manner wherein a plurality of shading bands having transparent abilities are vertically and spacedly formed on said shader slide for providing a vertical moving image when a light is passing through said shader slide;

an auxiliary moving picture frame, supported between said picture panel and said light source, comprising an auxiliary rolling device rotatably supported in said casing and an auxiliary shader slide arranged to be rotatably driven by said auxiliary rolling device in a movable manner wherein a plurality of shading stripes having a transparent abilities are spacedly formed on said auxiliary shader slide for providing a moving image when said light is passing through said auxiliary shader slide, and an electric input electrically connected said light source and said moving picture frame to a power source respectively;

thereby, said light generated by said light source is adapted for passing to said picture film through said shading bands and said shading stripes so as to reflect said moving images on said picture film.

2. A multi-picture frame, as recited in claim 1, wherein said auxiliary moving picture frame further comprises a shader film supported in front of the auxiliary shader slide wherein a plurality of shading steaks having transparent abilities are inclinedly and spacedly formed on the shader film for providing a transversely moving image on the picture film when the light is passing through said shading stripes longitudinally provided on said auxiliary shader slide and said shading steaks of said shader film respectively.

3. A multi-picture frame, as recited in claim 2, wherein said rolling device comprises a first roller gear and a second roller gear in parallel manner rotatably and horizontally mounted in said casing respectively wherein said shader slide is rotatably connected between said first and second roller gears in an endless rotating manner, and wherein said auxiliary rolling device comprises a first auxiliary roller gear and a second auxiliary roller gear in parallel manner positioned parallel to said first and second roller gears of said moving picture frame wherein said auxiliary shader slide is rotatably connected between said first and second auxiliary roller gears in an endless rotating manner, wherein said first auxiliary roller gear is rotatably engaged with said second roller gear in such a manner that said driving gear drives said second roller gear of said moving picture frame and said first auxiliary roller gear to rotate at said same time.

4. A multi-picture frame, as recited in claim 3, wherein said electric input comprises a motor supported in said receiving chamber for driving an output axle rotate, a driving gear connected to said output axle which drives said second roller gear to rotate, and an electric cable for electrically connected to said light source and a motor respectively electrically extended to said power source.

5. A multi-picture frame, as recited in claim 4, wherein said picture panel further comprises a film tension adjusting unit for maintaining a tension of said picture film wherein said film tension adjusting unit comprises a pair of adjusting shafts rotatably affixed to two opposed edge portions of said picture film respectively wherein a free end of said each adjusting shaft is penetrated through said casing to outside, and a pair of operating buttons affixed to said two free ends of said adjusting shafts respectively and arranged to rotatably move said picture film through said adjusting shafts.

6. A multi-picture frame, as recited in claim 5, wherein said light source comprises a fluorescent light transversely mounted at a bottom of said receiving chamber of said casing for generating light which is adapted for passing through said shader slide to said picture film.

7. A multi-picture frame, as recited in claim 2, wherein said auxiliary moving picture frame further comprises a shader film supported in front of the auxiliary shader slide wherein a plurality of shading steaks having transparent abilities are longitudinally and spacedly formed on the shader film for providing a transversely moving image on the picture film when the light is passing through said shading stripes inclinedly provided on said auxiliary shader slide and said shading steaks of said shader film respectively.

8. A multi-picture frame, as recited in claim 7, wherein said rolling device comprises a first roller gear and a second roller gear in parallel manner rotatably and horizontally mounted in said casing respectively wherein said shader slide is rotatably connected between said first and second roller gears in an endless rotating manner, and wherein said auxiliary rolling device comprises a first auxiliary roller gear and a second auxiliary roller gear in parallel manner positioned parallel to said first and second roller gears of said moving picture frame wherein said auxiliary shader slide is rotatably connected between said first and second auxiliary roller gears in an endless rotating manner, wherein said first auxiliary roller gear is rotatably engaged with said second roller gear in such a manner that said driving gear drives said second roller gear of said moving picture frame and said first auxiliary roller gear to rotate at said same time.

9. A multi-picture frame, as recited in claim 8, wherein said electric input comprises a motor supported in said receiving chamber for driving an output axle rotate, a driving gear connected to said output axle which drives said second roller gear to rotate, and an electric cable for electrically connected to said light source and a motor respectively electrically extended to said power source.

10. A multi-picture frame, as recited in claim 9, wherein said picture panel further comprises a film tension adjusting unit for maintaining a tension of said picture film wherein said film tension adjusting unit comprises a pair of adjusting shafts rotatably affixed to two opposed edge portions of said picture film respectively wherein a free end of said each adjusting shaft is penetrated through said casing to outside, and a pair of operating buttons affixed to said two free ends of said adjusting shafts respectively and arranged to rotatably move said picture film through said adjusting shafts.

11. A multi-picture frame, as recited in claim 10, wherein said light source comprises a fluorescent light transversely mounted at a bottom of said receiving chamber of said casing for generating light which is adapted for passing through said shader slide to said picture film.

12. A multi-picture frame, comprising:

a picture panel having a front transparent surface;

a casing having a receiving chamber mounted at a back of said picture panel;

at least a picture film rotatably supported in said casing and adapted for being view from said front transparent surface of said picture panel wherein said picture film has a plurality of transparent areas provided thereon adapted for enabling a light passing therethrough a light source disposed in said receiving chamber of said casing; and a moving picture frame mounted between said picture panel and said light source, comprising a rolling device rotatably supported in said casing and a shader slide arranged to be rotatably driven by said rolling device in a transversely movable manner wherein a plurality of shading bands having transparent abilities are vertically and spacedly formed on said shader slide for providing a vertical moving image when a light is passing through said shader slide;

an auxiliary moving picture frame, supported between said picture panel and said light source, comprising an auxiliary rolling device rotatably supported in said casing and an auxiliary shader slide arranged to be rotatably driven by said auxiliary rolling device in a movable manner wherein a plurality of shading stripes having a transparent abilities are spacedly formed on said auxiliary shader slide for providing a moving image when said light is passing through said auxiliary shader slide, and an electric input electrically connected said light source and said moving picture frame to a power source respectively;

thereby, said light generated by said light source is adapted for passing to said picture film through said shading bands and said shading stripes so as to reflect said moving images on said picture film.

13. A multi-picture frame, as recited in claim 12, wherein said auxiliary moving picture frame further comprises a first shader film supported in front of said auxiliary shader slide and second shader film supported in front of said shader slide, said first shade film comprising a plurality of first shading steaks having transparent abilities are inclinedly and spacedly formed on said shader film for providing a transversely moving image on said picture film when a light is passing through said shading stripes longitudinally on said auxiliary shader slide and said first shader film respectively, said second shader film comprising a plurality of second shading steaks having transparent abilities are inclinedly and spacedly formed on said second shader film for providing a transversely moving image on said picture film when a light is passing through said shader slide and said second shader film respectively, wherein said first shading steaks and said second shading steaks are inclinedly extended in opposite directions.

14. A multi-picture frame, as recited in claim 13, wherein said rolling device comprises a first roller gear and a second roller gear in parallel manner rotatably and horizontally mounted in said casing respectively wherein said shader slide is rotatably connected between said first and second roller gears in an endless rotating manner, and wherein said auxiliary rolling device comprises a first auxiliary roller gear and a second auxiliary roller gear in parallel manner positioned parallel to said first and second roller gears of said moving picture frame wherein said auxiliary shader slide is rotatably connected between said first and second auxiliary roller gears in an endless rotating manner, wherein said first auxiliary roller gear is rotatably engaged with said second roller gear in such a manner that said driving gear drives said second roller gear of said moving picture frame and said first auxiliary roller gear to rotate at said same time.

15. A multi-picture frame, as recited in claim 14, wherein said electric input comprises a motor supported in said receiving chamber for driving an output axle rotate, a driving gear connected to said output axle which drives said second roller gear to rotate, and an electric cable for electrically connected to said light source and a motor respectively electrically extended to said power source.

16. A multi-picture frame, as recited in claim 15, wherein said picture panel further comprises a film tension adjusting unit for maintaining a tension of said picture film wherein said film tension adjusting unit comprises a pair of adjusting shafts rotatably affixed to two opposed edge portions of said picture film respectively wherein a free end of said each adjusting shaft is penetrated through said casing to outside, and a pair of operating buttons affixed to said two free ends of said adjusting shafts respectively and arranged to rotatably move said picture film through said adjusting shafts.

17. A multi-picture frame, as recited in claim 12, wherein said auxiliary moving picture frame further comprises a first shader film supported in front of said auxiliary shader slide and second shader film supported in front of said shader slide, said first shade film comprising a plurality of first shading steaks having transparent abilities are longitudinally and spacedly formed on said shader film for providing a transversely moving image on said picture film when a light is passing through said shading stripes inclinedly on said auxiliary shader slide and said first shader film respectively, said second shader film comprising a plurality of second shading steaks having transparent abilities are inclinedly and spacedly formed on said second shader film for providing a transversely moving image on said picture film when a light is passing through said shader slide and said second shader film respectively.

18. A multi-picture frame, as recited in claim 17, wherein said rolling device comprises a first roller gear and a second roller gear in parallel manner rotatably and horizontally mounted in said casing respectively wherein said shader slide is rotatably connected between said first and second roller gears in an endless rotating manner, and wherein said auxiliary rolling device comprises a first auxiliary roller gear and a second auxiliary roller gear in parallel manner positioned parallel to said first and second roller gears of said moving picture frame wherein said auxiliary shader slide is rotatably connected between said first and second auxiliary roller gears in an endless rotating manner, wherein said first auxiliary roller gear is rotatably engaged with said second roller gear in such a manner that said driving gear drives said second roller gear of said moving picture frame and said first auxiliary roller gear to rotate at said same time.

19. A multi-picture frame, as recited in claim 18, wherein said electric input comprises a motor supported in said receiving chamber for driving an output axle rotate, a driving gear connected to said output axle which drives said second roller gear to rotate, and an electric cable for electrically connected to said light source and a motor respectively electrically extended to said power source.

20. A multi-picture frame, as recited in claim 19, wherein said picture panel further comprises a film tension adjusting unit for maintaining a tension of said picture film wherein said film tension adjusting unit comprises a pair of adjusting shafts rotatably affixed to two opposed edge portions of said picture film respectively wherein a free end of said each adjusting shaft is penetrated through said casing to outside, and a pair of operating buttons affixed to said two free ends of said adjusting shafts respectively and arranged to rotatably move said picture film through said adjusting shafts.

* * * * *